US005842771A

United States Patent [19]

Thrasher et al.

[11] Patent Number: 5,842,771

[45] Date of Patent: Dec. 1, 1998

[54] SUBMERSIBLE LIGHT FIXTURE

[75] Inventors: Laurence E. Thrasher; Darrin Kurt Pickle; Garrett J. Burkitt, III, all of Simi Valley, Calif.

[73] Assignee: American Products, Inc., Moorpark, Calif.

[21] Appl. No.: 552,559

[22] Filed: Nov. 3, 1995

[51] Int. Cl.[6] ..... F21V 31/00

[52] U.S. Cl. ..... 362/101; 362/267; 362/387; 362/364

[58] Field of Search ..... 362/96, 101, 158, 362/145, 267, 387, 310, 364

[56] References Cited

U.S. PATENT DOCUMENTS

| | | | |
|---|---|---|---|
| 1,106,631 | 8/1914 | Davis, Jr. | 362/387 |
| 3,801,022 | 4/1974 | Cassey | 362/101 |
| 3,864,562 | 2/1975 | Hawkins | 362/267 |
| 3,949,213 | 4/1976 | Paitchell | 362/101 |
| 4,539,629 | 9/1985 | Poppenheimer . | |
| 5,000,665 | 3/1991 | Moeller . | |
| 5,045,978 | 9/1991 | Gargle . | |
| 5,051,875 | 9/1991 | Johnson . | |
| 5,144,540 | 9/1992 | Hayes . | |
| 5,169,228 | 12/1992 | Breitzler . | |
| 5,264,997 | 11/1993 | Hutchisson et al. . | |
| 5,349,505 | 9/1994 | Poppenheimer . | |
| 5,375,046 | 12/1994 | Narumi et al. . | |
| 5,408,397 | 4/1995 | Tyson . | |
| 5,432,688 | 7/1995 | Tobias et al. | 362/101 |

FOREIGN PATENT DOCUMENTS

| | | | |
|---|---|---|---|
| 2021749 | 12/1979 | United Kingdom | 362/267 |

*Primary Examiner*—Thomas M. Sember
*Attorney, Agent, or Firm*—Pretty, Schroeder & Poplawski

[57] ABSTRACT

A submersible light having an electrically nonconductive reflector and no other electrically conductive elements requiring grounding, a tough lens to withstand impacts from swimmers and features providing quick and easy serviceability. Because of these features, the light of the invention meets safety requirements allowing the light to be mounted less that 18 inches below the waterline, thereby allowing its placement in areas of pools that have been heretofore off limits to conventional lights. In addition, a cord holder about the external surface of the light's housing and twist lock base and housing with a radial O-ring seal provide for quick and easy disassembly and re-installation of the light.

27 Claims, 5 Drawing Sheets

FIG. 3
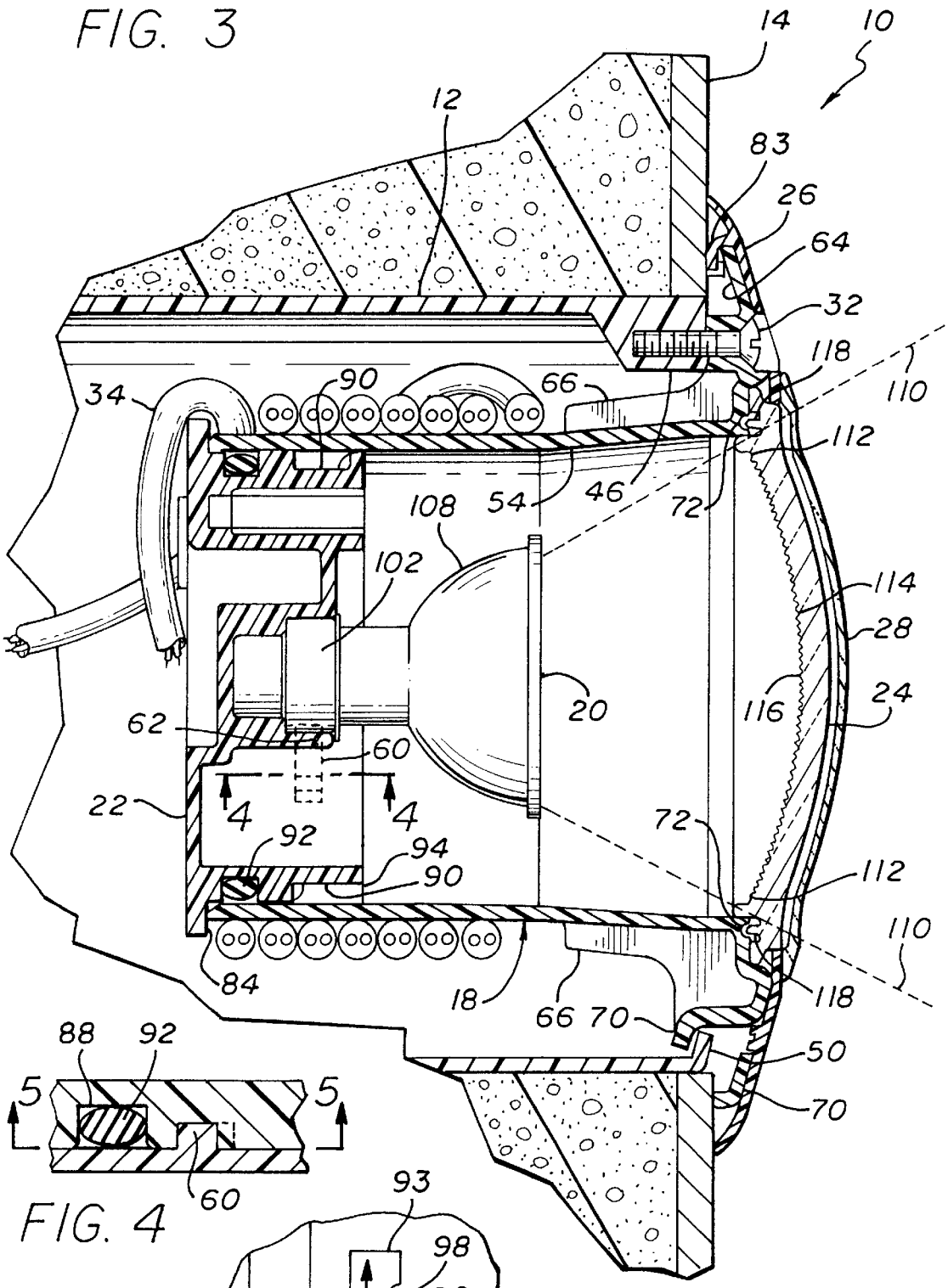
FIG. 4
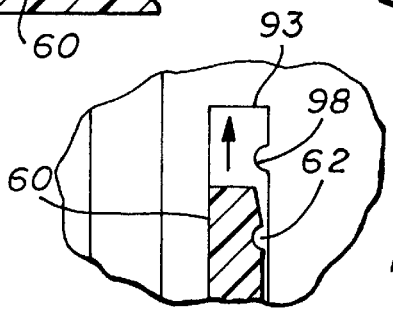
FIG. 5

SUBMERSIBLE LIGHT FIXTURE

FIELD OF THE INVENTION

The present invention relates to an apparatus and method for illumination, and, more particularly, to the illumination of liquid containers, such as pools, spas and the like.

BACKGROUND OF THE INVENTION

Swimming pools and spas are well known and provide recreational and health benefits to many people across the United States. Swimming pools and spas typically have water circulation systems that include electrical devices such as pumps and heaters. Further, many pools and spas have submersible lights located under the waterline to illuminate the water at night, thereby making the pool or spa safe and aesthetically appealing to swimmers.

Because of such electrical devices, swimming pools and spas are subject in most jurisdictions to restrictive codes intended to reduce the chance of accidental electric shock to swimmers. Typically, all conductive elements associated with a pool or spa, including submersible lights, are grounded in a conductive net. Additionally, a separately grounded electrical panel supplies power to electrical devices around the pool, such as transformers, pumps and lights.

A conventional submersible pool light typically is mounted within a conductive niche that is integrally associated with the side of the pool and is electrically grounded to the pool grounding net. This niche has a dome-shaped housing featuring an opening that is generally aligned with the pool wall and an interior cavity that is sized to accept a pool light. The interior cavity of the niche extends underground away from the pool wall so that the pool light can be mounted flush with the wall of the pool. The rear of the niche has a port that provides a sealed opening for a power cord to extend from the light to the pool's electrical panel. The front of the light does not seal the niche from the pool water: instead, pool water is admitted into the niche to cool the light.

The aforementioned conventional submersible pool light has a housing with an electric light bulb sealed therein, a lens located in front of the light bulb and a bezel around the lens to mount the light to the niche and cover the periphery of the niche for aesthetic purposes. This pool light typically has at least one electrically conductive element, such as a metal reflector mounted adjacent to the light bulb or a metal housing or other metal components. Accordingly, this pool light must be grounded to the pool's conductive net by a ground wire. The power cord of this light also contains a ground conductor leading to the pool's electrical panel.

While pool lights of the previously described type are generally acceptable, under certain circumstances such lights can have certain drawbacks. In particular, the electrically conductive reflector of the light can radiate electrical energy into a pool or spa if a fault occurs elsewhere in the pool's electrical service. Normally, if the electrical service of the pool has been properly installed and maintained the effect of such a fault will be minimal. However, sometimes the electrical service is not properly installed or maintained. In such cases, a fault on the electrical service ground can cause electricity to radiate from the conductive reflector, housing or other metal components, into the pool, resulting in harm to swimmers. Because of this possibility, submersible lights are required to be installed at least 18 inches below the waterline, where radiation of electricity would cause less harm to swimmer. In particular, because a shock from the light would be concentrated in a location away from the waterline, the heart and head of a typical swimmer would be less likely to bear the brunt of the electric shock.

There is another requirement that a pool light must satisfy for it to be mounted less than 18 inch below the waterline. This requirement mandates that the light withstand a predetermined impact so that accidental breakage of the light by a swimmer is less likely. Conventional pool lights have previously had glass lenses because of the high temperature of the light bulb, which must be sized to provide adequate light to the pool. Because glass lenses are relatively brittle, they have sometimes been unable to satisfy the aforementioned impact requirement.

The aforementioned requirement for mounting a pool light less than 18 inches below the waterline is of great concern because many pool and spa owners wish to install lights in the shallow end of the pool or in steps that are less than 18 inches below the waterline. Considering that pool walls often curve at depths of less than 18 inches to blend with the bottom surface and that light niches are intended for installation in flat wall surfaces, the typical pool therefore has limited locations for pool lights because they must be mounted in flat wall surfaces 18 inches below the waterline. Accordingly, the areas where conventional pool lights can be located are limited, thereby unduly restricting the illumination of the pool.

This 18 inch depth requirement also gives rise to another concern, namely, efficient and aesthetic lighting of the pool. Generally speaking, a specific amount of light must be reflected from the pool light onto the walls and bottom of a pool to provide the illumination necessary for a safe and inviting pool. However, when a pool light illuminates a pool, it does so with some inefficiency because some of its light escapes directly from the pool by crossing the flat water-to-air boundary. Accordingly, if some of the light escapes from the pool without illuminating the sides or bottom, a higher power light is required to provide such a safe and inviting appearance for swimmers. This inefficient illumination results in higher electricity bills for the operator of the pool and increases the cost of the light, which has a higher power light bulb than would otherwise be needed.

The light that escapes from a lit pool intersects the air-to-water boundary at an angle of incidence that is less than a reference angle known as the "critical angle." Both the angle of incidence and the critical angle are measured from the normal to the flat water-to-air boundary. For a water-to-air boundary, an angle of incidence of 48.5 degrees or more will cause total reflection of light back into the pool. Accordingly, pool lights mounted at the previously mentioned 18 inch depth tend to be inherently inefficient because some of their light will intersect the waterline at an angle of less than 48.5 degrees, thereby directly escaping without ever reflecting off of the pool's bottom or walls.

Another submersible light has been developed in an effort to address the foregoing problems. While this light is generally effective in lighting pools, under some circumstances it may be subject to the same drawbacks discussed above. In particular, this light utilizes an electrically conductive metal reflector and a glass lens. The metal reflector requires a ground wire connected to the pool's conductive net, which increases the manufacturing cost of the light. Furthermore, under certain circumstances, such as an incorrect or damaged installation, there is a risk that the metal reflector could radiate electrical energy into the pool and harm swimmers. The glass lens of this light also could have difficulty satisfying the impact test for the light to be mounted less than 18 inches below the waterline. The pool light shown in the U.S. patent to Poppenheimer, U.S. Pat. No. 5,349,505, may have some of the characteristics described above, although applicants are not aware of any specific information regarding this light beyond what is shown in the patent.

Another drawback of conventional submersible pool lights is the difficulty of servicing them. Periodically, a pool light must be removed from its niche to replace a burnt-out bulb or attend to other service or maintenance. Typically, conventional pool lights have a power cord long enough to extend from the niche to the sidewalk (commonly referred to in the pool industry as the "deck") next to the pool to allow the light to be brought above the waterline for servicing once it has been removed from the niche. Once brought out of the niche and onto the pool sidewalk, a conventional pool light is difficult to disassemble because it has many mechanical fasteners holding a bezel or face plate onto its housing. These fasteners must be removed with tools, which takes time and effort. These mechanical fasteners are required at least in part to provide a large force to hold a conventional axial seal between the faceplate and the housing.

Finally, when the light is reassembled, it must be re-inserted into the niche. Such re-insertion is difficult because the long power cord must be located in the niche, which must accommodate the light as well. Although the power cord can be wrapped around the housing of the light (which is usually tapered), the light typically has nothing to hold the coiled cord. Accordingly, the cord can slide off the housing of the light and create an obstruction that blocks the insertion of the light into the niche. Such interference only makes the servicing of the many-fastener light more awkward, difficult and frustrating.

It should, therefore, be appreciated that there is a need for a submersible light that has the following features: no conductive elements requiring grounding, a tough lens to withstand impacts from swimmers, and quick and easy serviceability. The present invention fulfills all of these needs.

SUMMARY OF THE INVENTION

The present invention provides a submersible light assembly that has the following features: no conductive elements requiring grounding, and a tough lens to withstand impacts from swimmers and quick and easy serviceability. Because of these features, the light of the invention meets safety requirements for the light to be mounted less than 18 inches below the waterline, thereby allowing its placement in areas of pools that have been heretofore off limits. In addition, a cord holder and a twist-lock base provide for quick and easy disassembly and re-installation of the light.

The submersible light assembly includes an electrically nonconductive and hollow housing having a peripheral wall. A lens mount extends across an open front end of the peripheral wall and is connected thereto. A plastic lens is mounted in the lens mount. An end cap is releasably mounted in the peripheral wall at the rear end of the housing. A light source is located within the housing and has a socket and an electric light mounted in the socket. The electric light has an electrically nonconductive reflector positioned to direct light through the lens. A two wire electric cord is connected to the socket to deliver electric power thereto. The electric cord passes through the end wall of a niche and through the end cap of the housing. The housing, lens, lens mount, and end cap are all made of electrically nonconductive material.

In a more detailed aspect of the invention, a transformer remotely located from the housing powers the electric light. The transformer has an isolated voltage input and voltage output. The voltage output of the transformer is coupled to the light socket to define a light circuit. The only conductive material of the light is that of the light circuit and the light. Therefore, no ground wire is needed on the submersible light so the light poses no danger of radiating electricity out into the pool. In other more detailed aspects of the invention, the light is of the type having a glass prismatic reflector, the lens of the light is made from clear polymeric material and the housing of the light is made from a glass filled polymeric material.

A major advantage of the submersible light is that it contains no conductive material capable of radiating potentially dangerous electricity out into the pool. Therefore, the submersible light is safer than conventional pool lights and can be mounted less than 18 inches below the waterline in a myriad of locations within swimming pools or spas.

In other aspects of the invention, a submersible light is provided that has a housing having a forward end, a rearward end, an external surface therebetween and a power cord. A front flange is located adjacent to the forward end of the housing and extends radially outwardly from the external surface of the housing. A rear flange is located adjacent to the rearward end of the housing and extends radially outwardly from the external surface of the housing. When the light is installed into the niche, the power cord can be advantageously wrapped around the housing and held between the front and rear flanges to secure the power cord for easy installation of the light. In other more detailed aspects of the invention, a cord catch is provided to more securely fasten the cord to the housing. In yet another detailed aspect, the cord extends from the housing at an angle to advantageously facilitate wrapping of the cord about the housing.

In yet other aspects of the invention, a submersible light is provided that includes a housing having a forward end, a rearward end, and internal surface therebetween defining a chamber sized to enclose a light, an opening in the forward end of the housing and an opening in the rearward end of the housing. A lens is mounted across the forward opening of the housing to seal the chamber in the housing. A base is mounted across the rearward opening of the housing. The base has a twist lock configured to engage the housing to secure the base to the housing and hold a seal in a predetermined position radially between the base and the housing to prevent fluid from entering the chamber of the housing. Detentes and matching projections can be formed in the twist lock mechanism to lock the base to the housing so that the radial seal is located in a predetermined position between the housing and the base.

One advantage associated with the twist lock feature described above is that it provides for the quick and easy disassembly of the submersible light. Such quick and easy action of the twist lock works in concert with the radial seal, which seals with less force than a conventional axial compression seal, thereby alleviating the need for the plurality of fasteners of conventional pool lights.

Other features and advantages of the present invention will become apparent from the following description of the preferred embodiment, taken in conjunction with the accompanying drawings , which illustrate, by way of example, the principles of the invention.

BRIEF DESCRIPTION OF THE DRAWINGS

The following drawings illustrate the preferred embodiment of the invention. In the drawings:

FIG. 3 is an elevational view of the submersible light installed in the pool niche of FIG. 1, shown in cross-section;

FIG. 4 is a detail cross sectional view of the submersible light taken about lines 4—4 of FIG. 3;

FIG. 5 is a detail elevational view of the submersible light taken about lines 5—5 of FIG. 4;

DETAILED DESCRIPTION OF THE PREFERRED EMBODIMENT

Figure 1:
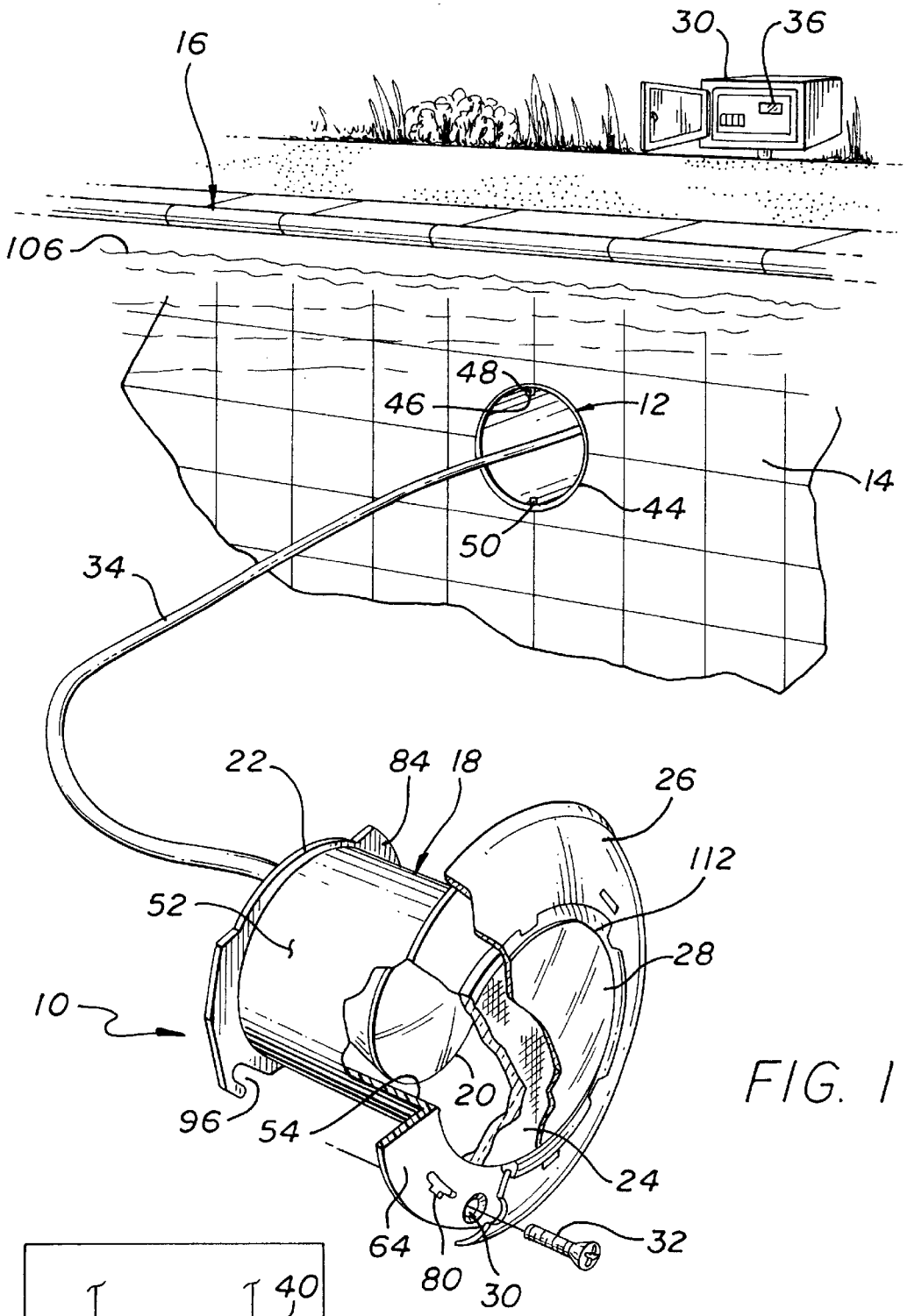
FIG. 1 is a perspective view a submersible light removed from a niche located in the wall of a pool.
Figure 1A:
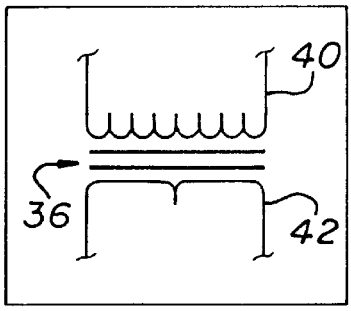
FIG. 1A is a schematic view of a primary and secondary winding of a transformer for the submersible light shown in FIG. 1.
Figure 2:
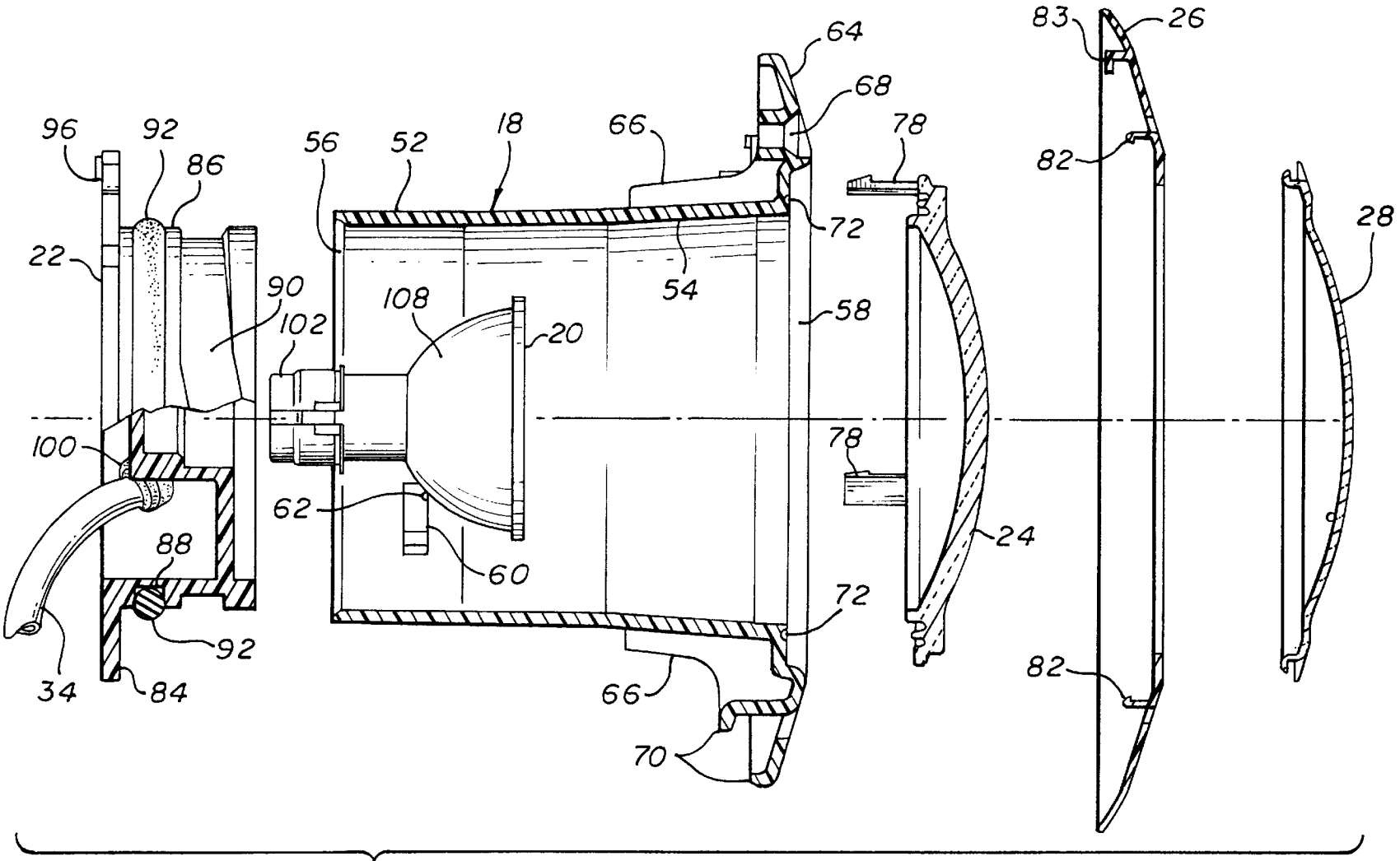
FIG. 2 is an exploded elevational view of the submersible light of FIG. 1, shown in partial cross section.

As shown in the exemplary drawings, the present invention is embodied in a submersible light, generally referred to by the reference numeral 10, for use within a niche 12 preferably mounted in the wall 14 of a swimming pool 16. The light 10 has a tubular housing 18 enclosing a light bulb 20, a base 22 mounted to the rear of the housing 18, and a lens 24 mounted on the front of the housing 18. A decorative bezel 26 also is mounted to the front of the housing to removably hold a colored filter 28 over the lens 24 of the light 10 for aesthetic purposes (FIGS. 1 and 2). The bezel 26 defines a hole 30 sized to accept a mounting screw 32 that engages the niche 12 to hold the light 10 therein. A two-conductor power cord 34 extends from the base 22 at the rear of the light 10, through the niche 12 and to an isolation transformer 36 located in a junction box 38. The isolation transformer 36 has a primary winding 40 and a secondary winding 42 that is isolated from the primary winding (FIG. 1A). The transformer 36 steps down 110 volts A.C. to a low voltage (i.e., less than 15 volts A.C.) to power the light bulb 20.

The niche 12, also commonly known as a wet-niche or a fixture housing, has standard characteristics that are well known in the pool products industry. Among these characteristics is a main opening 44 having an upper flange 46 defining a hole 48 sized to accept the bezel screw 32 to fasten the light to the niche 12. The niche 12 also has a lower flange 50 sized to clip into the bottom of the light's housing 18 to retain it in the niche 12. A common sealed port (not shown) located in the rear of the niche 12 accommodates the power cord 34 of the light 10. Niches of the type described above are available from the American Products, Inc. of Moorpark, Calif. Now the individual components of the preferred submersible light 10 will be discussed.

Figure 8:
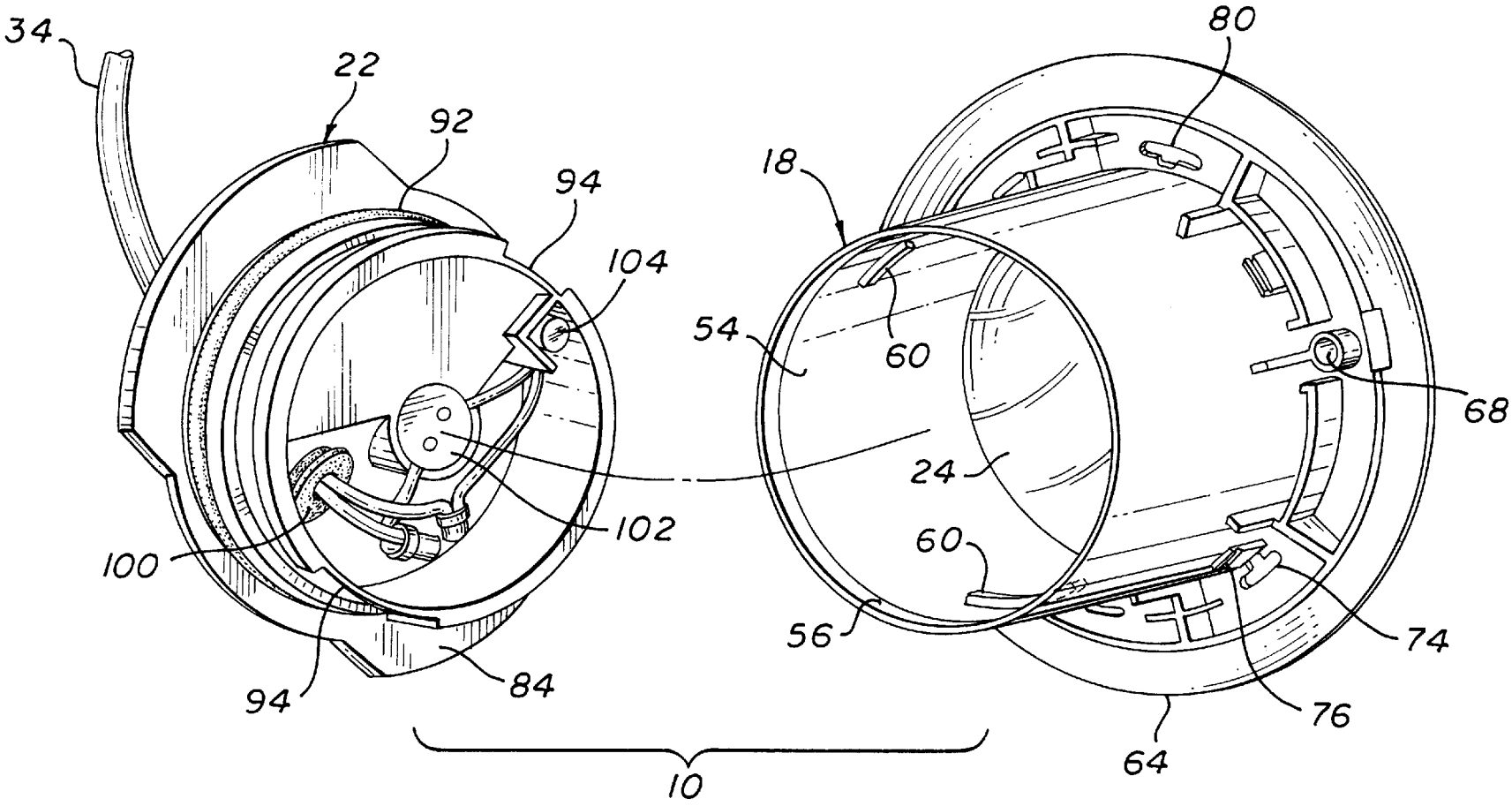
FIG. 8 is an exploded perspective view of the submersible light shown in FIG. 1.

The housing 18 of the submersible light 10 preferably has a generally cylindrical exterior surface 52 and a generally cylindrical interior surface 54 that defines a rear opening 56 and a front opening 58 (FIGS. 2, 3 and 8). The interior surface 54 has a diameter sized to enclose a portion of the base 22 and the light bulb 20, as described below. The interior surface 54 of the housing 18 also features two opposed projections 60, one of which is longer (as measured along the circumference of the housing's interior surface 54) than the other. Each projection 60 has a forward facing notch 62. A flange 64 extends radially outwardly from the front opening 58 of the housing 18. Reinforcing fins 66 extend between the front flange 64 and the exterior surface 52 of the light 10. The fins 66 are generally evenly distributed around the exterior surface 52 of the housing 18. A hole 68 is located on the top of the flange 64 to allow the bezel mounting screw 32 to pass therethrough to engage the niche 12. The lower portion of the front housing flange 64 has an angled retainer clip 70 sized to engage the lower flange 50 of the niche. A groove 72 is located concentrically around the front opening 58 of the housing 18 to hold sealant therein to seal the lens 24 to the housing 18. Four holes 74 are evenly distributed around the front opening 58 of the housing 18. Inside each of these openings 74 a tab 76 is mounted to engage barbed clips 78 projecting from the lens 24. Another set of holes 80 is located on the housing flange 64 to engage barbed clips 82 on the bezel 26. A retainer clip 83 on the bezel 26 snaps over the housing flange 64 to clip the bezel 26 to the housing 18. The holes 80 allow water to pass therethrough for cooling of the light 10. The rear opening 56 of the housing 18 mates with the base 22 of the light 10, which is hereinafter described.

Figure 6:
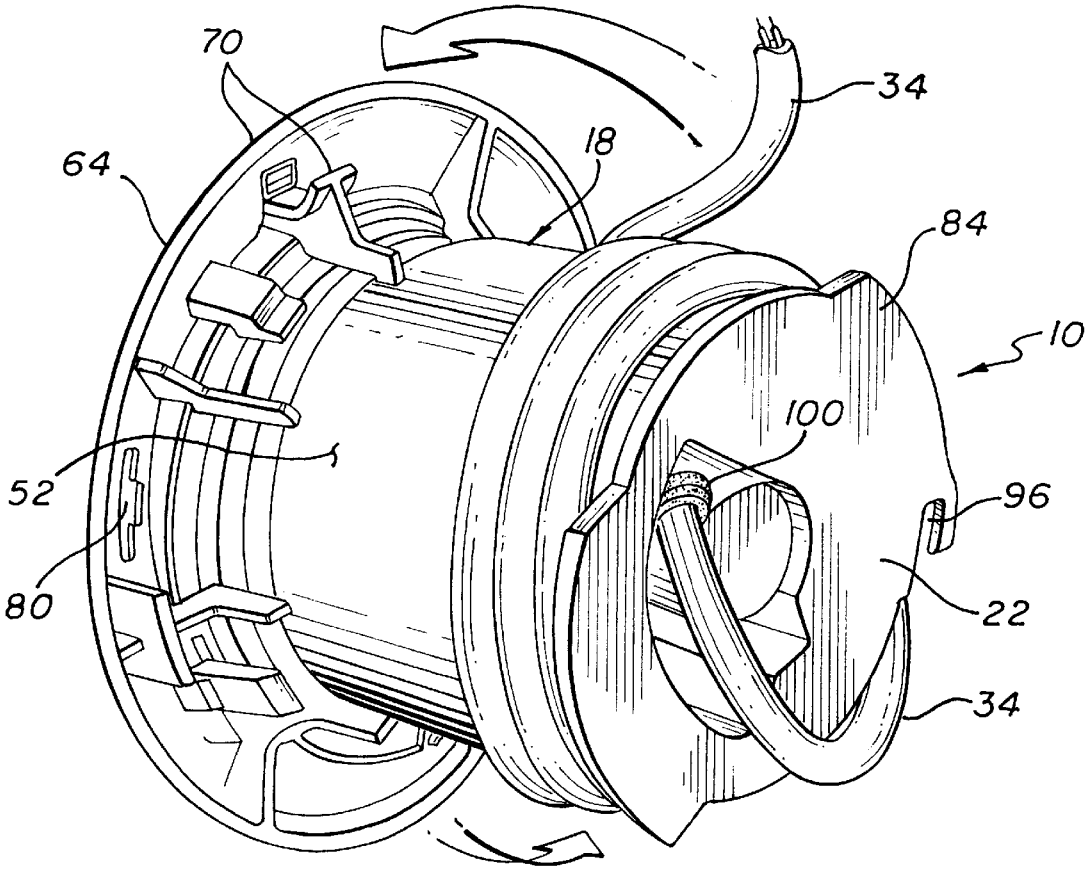
FIG. 6 is a perspective view of the submersible light shown in FIG. 1, showing a power cord partially wrapped thereabout.
Figure 7:
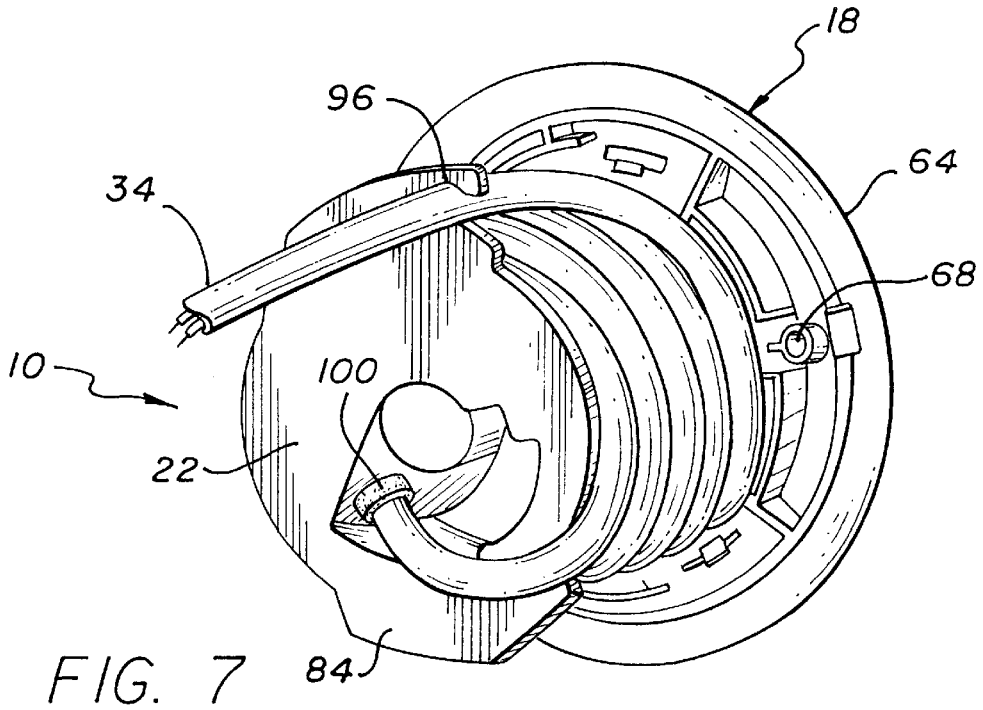
FIG. 7 is a perspective view of the submersible light shown in FIG. 1, showing the power cord wrapped thereabout.

The base, otherwise known as an endcap, 22 of the preferred submersible light 10 has rear flange 84 and an exterior surface 86 defining a circular circumferential slot 88 and a two opposed, forwardly curving slots 90 for engagement with the housing 56 of the light 10 (FIGS. 2 and 3). The circular slot 88 is sized to accept an elastomeric O-ring 92 that provides a radial seal between the base 2 and the interior surface 54 of the housing 22. Each of the opposed curving slots 90 extends 180 degrees around the base 18 to a stop surface 93. Each curving slot 90 has an opening 94 keyed to the length of an associated one of the projections 60 on the inside 54 of the housing 18 (FIG. 8). Such a keyed arrangement-ensures that the base 22 is inserted into the housing 18 in a correct orientation wherein a thermostat 104 mounted in the base 22 comes to rest in a position above the light bulb 20 and immediately adjacent to the housing's interior surface 54. The curved slots 90 include small projections 98 that are sized to engage the detentes 62 formed on the projections 60 within the housing (FIG. 5). These small projections 98 are located to engage the detentes 62 on the projection 60 when the base 22 and housing 18 are in a position ensuring that the O-ring 92 is fully engaged radially between the interior surface 54 of the housing 18 and the circular slot 88 of the base 22. The power cord 34 projects from a water tight seal 100 in the base 22 at an angle to position the cord 34 in an orientation that facilitates the winding of the cord 34 around the external surface 52 of the housing 18 (FIG. 6 and 7). The base 22 also contains a socket 102 sized to accept the bulb 20. To avoid overheating of the light 10, the thermostat 104 turns the light bulb 20 off if the temperature inside the housing 18 exceeds 100 degrees centigrade.

Together, the curved 180 degree slots 90 engage the projections 60 on the interior surface 54 of the housing 18 to allow the base 22 to easily twist on to the housing 18. One advantage associated with this twist lock feature described above is that it provides for the quick and easy disassembly of the preferred submersible light 10. Such quick and easy action of the twist lock works in concert with the radial seal 92, which seals with less force than a conventional axial compression seal, thereby alleviating the need for the plurality of fasteners of conventional pool lights.

The notched cord catch 96 on the flange 84 of the base 22 enables the power cord 34 to be wrapped and held around the exterior surface 52 of the housing 18 between the flange 84 of the base 22 and the front flange 64 of the housing 18 (FIGS. 6 and 7). The power cord 34 is long to enable the light 10 to be removed from the niche 12 and brought above the waterline 106 for service. The cooperating flanges 84 and 64 and the cord catch 96 advantageously allow any excess power cord 34 to be neatly wrapped about the housing 18 during installation of the light 10 into the niche 12. Accordingly, the power cord 34 of the preferred light 10 does not interfere with the installation of the light 10 into the niche 12 after the light 10 has been removed for servicing. The materials used in the construction of the preferred light 10 will now be described.

The housing 18 and the base 22 are both made of a non-electrically conductive, tough, heat resistant material. This material should be thermally conductive to allow the pool water to cool the light. Along these lines, a glass filled polymeric material is presently preferred. One material from which the housing can be made is VALOX brand polymeric material sold by the General Electric Corporation of Pittsfield, Mass., which is a 20% glass filled polyester material. The glass filling enables the base 22 and the housing 18 to dissipate heat from the light bulb 20 by conducting it to the pool water surrounding the light 10. Without such thermal conductivity, a conventional polymeric housing and base would probably melt from the heat given off by the light bulb 20. Accordingly, the preferred light 10 advantageously has a nonconductive housing 18 and base 22 that are heat resistant, thereby allowing for the use of a more powerful light bulb 20, which increases the amount of light diffused into the pool.

The light bulb 20 is preferably a 12 volt A.C., 75 watt, type MR-16 bulb with a built-in glass prism reflector 108, although other low voltage light bulbs may be suitable. The prism reflector 108 diffuses light in a twenty degree frustoconical space 110 in front of the light bulb (FIG. 3). The lens 24 is sized and spaced from the light bulb 20 so that the boundary of this frustoconical space is generally aligned with the periphery 112 of the lens 24. This arrangement provides efficient diffusion of light into the pool. The lens has an inside surface 114 defining dimples 116 preferably having a 0.04 inch radius. The components of the preferred light 10 can be made by the use of commonly known plastic molding techniques.

The lens 24 is made from a tough, non-electrically conductive, transparent material such as grade 3103 MAKROLON brand polycarbonate material sold by Bayer Aktiengesellschaft of Leverkusen, Germany or other clear materials that are tough and heat resistant. This polycarbonate material is nonconductive and is tough enough to withstand the impact test required for lights that are mounted less than eighteen inches below the waterline of the pool. The lens 24 also is heat resistant and will not melt from the heat given off by the light bulb 20, which, as described above, is spaced from the lens 20 to allow maximum diffusion of light into the pool. The barbed clips 78 of the lens 24 extend rearwardly to engage the front flange 64 of the housing 18 (FIG. 2 and 3). These clips 78 are sized to pass through the holes 74 in the front flange 64 of the housing and engage the small tabs 76 mounted therein to hold the lens 24 to the housing 18. A tongue 118 is located concentrically about the periphery of the lens 24 and is sized to mate with the groove 72 on the housing 18. Commonly available polyurethane sealant is placed between the tongue 118 of the lens 24 and the housing's groove to permanently mount the lens 24 to the housing 18.

An important advantage associated with the preferred submersible light 10 is that it contains no conductive material capable of radiating potentially dangerous electricity out into the pool. Therefore, the submersible light is safer than conventional pool lights and can be mounted less than 18 inches below the waterline in a myriad of locations within swimming pools or spas.

It should be appreciated from the foregoing description that the preferred submersible light 10 has the following features: no conductive elements requiring grounding and a tough lens 24 to withstand impacts from swimmers and quick and easy serviceability. Because of these features, the preferred light 10 meets safety requirements allowing the light to be mounted less that 18 inches below the waterline, thereby allowing its placement in areas of pools that have been heretofore off limits. Further, because no electrically conductive elements in the light 10 require grounding, no ground wires are needed and, thus, the light can be powered by a two conductor power cord 34, thereby reducing the cost of the light. The cord catch 96 and twist lock base 22 and housing 18 engagement provide for quick and easy disassembly and re-installation of the light 10.

While a particular form of the invention has been illustrated and described, it will be apparent that various modifications can be made without departing from the spirit and scope of the invention. Accordingly, it is not intended that the invention be limited, except as by the appended claims and equivalents thereof.

We claim:

1. A lighting assembly for installation in a wall of a pool, the lighting assembly comprising:

a niche mounted in the wall, the niche having a bowl like shape extending around a horizontal axis and having a peripheral wall, an open front end facing into the poll and a closed end spaced rearwardly from the front end;

a generally cylindrical hollow light housing releasably connected to the niche extending concentrically within an interior of the niche, said light housing having a peripheral wall in spaced relation from said peripheral wall of said niche;

a lens mount extending across an open front end of said peripheral wall of the housing and connected thereto;

a plastic lens mounted in said lens mount;

an end cap releasably mounted in a rear end of said housing to said peripheral wall of the housing;

a light source positioned within said light housing;

an electrically conductive light socket mounted in said end cap;

and electric light releasably mounted in said light socket and having an electrically conductive reflector positioned to direct light through said lens; and a two wire electric cord connected to said socket delivering electric power thereto and passing through said closed end of said niche and through said end cap;

said light housing, said lens, said lens mount, and said end cap all being made of electrically nonconductive material.

2. The lighting assembly of claim 1, further comprising:

a transformer remotely located from the housing, said transformer having a voltage input isolated from a voltage output, the voltage output of the transformer coupled to said electric cord.

3. The lighting assembly of claim 2, wherein said transformer has a primary winding separated from a secondary winding.

4. The lighting assembly of claim 3, wherein said transformer has a low voltage output.

5. The lighting assembly of claim 1, wherein said housing has a front flange and the end cap has a rear flange to hold said electric cord wrapped therebetween.

6. The lighting assembly of claim 5, wherein said rear flange has a cord catch to secure said wrapped electric cord to the housing.

7. The lighting assembly of claim 6, wherein said electric cord extends from said end cap at an angle to facilitate the wrapping of said cord about the housing.

8. The lighting assembly of claim 1, wherein said rear flange has a cord catch to secure said wrapped electric cord to the housing.

9. The lighting assembly of claim 8, wherein said cord catch is a notch sized to snugly accept said electric cord therein.

10. The lighting assembly of claim 9, wherein said cord extends from said end cap at an angle to facilitate wrapping said cord about said housing.

11. The lighting assembly of claim 8, wherein said cord extends from said end cap at an angle to facilitate wrapping said cord about said housing.

12. The lighting assembly of claim 1, wherein said electric cord extends from said end cap at an angle to facilitate wrapping said cord about said housing.

13. The lighting assembly of claim 1, wherein said housing has a projection on its interior surface adjacent to its rear end, and wherein said end cap has a forward end, a rearward end, and a circumferential surface located therebetween, the circumferential surface defining a slot extending circumferentially around said base and curving longitudinally forwardly, the slot sized to engage the projection so that rotation of said base causes the projection to interferingly ride within the slot, so that said base is pulled longitudinally into the rear end of said housing.

14. The lighting assembly of claim 13, wherein a seal is located about said end cap, radially between said base and said housing.

15. The lighting assembly of claim 14, wherein the circumferential surface of said end cap further defines a small projection in said slot, the small projection sized to engage a detente in the projection on the interior surface of said housing, when the seal has fully engaged said housing.

16. The lighting assembly of claim 1, wherein said reflector light diffuses light along a 10 to 40 degree arc of frustoconical space.

17. The lighting assembly of claim 1, wherein said reflector diffuses light along an approximately twenty degree arc of frustoconical space.

18. A method of installing a submersible lighting system within a structure intended to hold water, such as a pool, the structure of the type having a niche with a port sized to accept a power cord therethrough, the method comprising the steps of:

placing a transformer in a location away from the niche, the transformer having a voltage input isolated from a voltage output;

placing a submersible light within the niche, the submersible light made entirely of electrically nonconductive materials except for a conductive socket mounted within a housing of the submersible light and the power cord coupled to the conductive socket and extending from the light; and placing the power cord through the port of the niche and coupling it to the voltage output of the transformer so that no ground wire need be connected to the submersible light.

19. A method of installing a submersible light into a niche located in a pool wall the light has a power cord and has an exterior surface with two longitudinally spaced flanges mounted thereon, the method comprising:

wrapping the power cord around the exterior surface and between the flanges;

locking the power cord into a notch on one of the flanges after said wrapping of the power cord about the exterior surface of the light;

inserting the light into the niche, the power cord held between the flanges on the light so as to not interfere with such insertion of the light; and securing the light to the niche.

20. The method of claim 19, further comprising mounting the power cord to the light so that it extends therefrom at an angle to facilitate the wrapping of the cord about the exterior surface of the light.

21. A lighting assembly for installation in a wall of a pool, the lighting assembly comprising:

a niche for mounting in the wall; and a light including, a housing having an open front portion and an open rear portion, wherein the housing is configured to mount to the niche, a lens configured to mount to the open front portion, and a base configured to mount to the open rear portion;

wherein the housing, lens, and base consist of nonconductive material.

22. The lighting assembly of claim 21 further comprises an electric cord for delivering electric power to the light.

23. The lighting assembly of claim 22, wherein the base includes a flange with a cord catch thereon for securing the electric cord.

24. The lighting assembly of claim 22, wherein the electric cord projects from the base at an angle that facilitates winding of the electric cord around the housing.

25. The lighting assembly of claim 21, wherein the housing includes an interior surface with a first projection formed thereon, the base includes an exterior surface with a slot formed therein for engaging the first projection, and wherein the first projection and the slot are configured to allow the base to twist on to the housing to releasably mount the base to the open rear portion.

26. The lighting assembly of claim 25, wherein the first projection includes a detente and the slot includes a second projection, and wherein the projection and the detente are configured to releasably engage when the base is twisted on to the housing.

27. A lighting assembly for installation in a wall of a pool, the lighting assembly comprising:

a niche for mounting in the wall; and a light including, a two wire electric cord for delivering electric power to the light;

a nonconductive housing having an open front portion and an open rear portion, wherein the housing is configured to mount to the niche, and the housing includes an interior surface with a projection formed thereon;

a nonconductive base including an exterior surface with a slot formed therein for engaging the first projection, and the projection and the slot are configured to allow the base to twist on to the housing to releasably mount the base to the open rear portion, and wherein the base includes a flange with a cord catch thereon for securing the electric cord, and the electric cord projects from the base at an angle that facilitates winding of the electric cord around the housing.

* * * * *

UNITED STATES PATENT AND TRADEMARK OFFICE

CERTIFICATE OF CORRECTION

PATENT NO. : 5,842,771

DATED : December 1, 1998

INVENTOR(S) : Thrasher, Laurence E., et al.

It is certified that error appears in the above-identified patent and that said Letters Patent is hereby corrected as shown below:

Column 9, line 9, delete "1" and insert --5--.
Column 9, line 41, delete the first appearance of the word "light".

Signed and Sealed this

Twenty-ninth Day of June, 1999

*Attest:*

Q. TODD DICKINSON

*Attesting Officer*

*Acting Commissioner of Patents and Trademarks*